US006014974A

United States Patent [19]

Possamai

[11] Patent Number: 6,014,974

[45] Date of Patent: Jan. 18, 2000

[54] MULTI-PURPOSE ACCESSORY FOR SMOKERS

[76] Inventor: Mario Possamai, Via Asiago, 2, Conegliano, Italy, 31015

[21] Appl. No.: 09/055,282

[22] Filed: Apr. 6, 1998

[51] Int. Cl.[7] ..... A24F 47/00

[52] U.S. Cl. ..... 131/185; 131/235.1; 131/234; 131/238; 131/240.1; 131/241; 131/242

[58] Field of Search ..... 131/235.1, 234, 131/238, 240.1, 241, 242, 185

[56] References Cited

U.S. PATENT DOCUMENTS

| | | | |
|---|---|---|---|
| 1,782,026 | 11/1930 | Beyer | 131/238 |
| 1,841,389 | 1/1932 | Weis | 131/238 |
| 2,629,388 | 2/1953 | Duhaime et al. | 131/242 |
| 2,755,919 | 7/1956 | Genshaw et al. | 131/242 |
| 2,777,569 | 1/1957 | Starke, Jr. | 131/238 |
| 3,018,877 | 1/1962 | Posavic | 131/242 |
| 3,052,346 | 9/1962 | Maron | 131/241 |
| 3,143,116 | 8/1964 | Gedeon | 131/238 |
| 3,472,239 | 10/1969 | Gielow et al. | 131/241 |
| 5,520,196 | 5/1996 | Yang | 131/238 |

*Primary Examiner*—James Derrington
*Assistant Examiner*—Michael P. Colaianni
*Attorney, Agent, or Firm*—Hoffman, Wasson & Gitler

[57] ABSTRACT

A multi-purpose accessory is a substantially parallelepiped rigid casing (1) able to house a packet (3) of cigarettes and a cigarette lighter (4). The casing has a major surface with a shaped depression (6) for resting the cigarette. An end portion of the casing has a cylindrical body (7) in which a cylindrical container (11) is inserted. The cylindrical body (7) has a longitudinally slotted hole (9). The cylindrical container has a longitudinally slotted aperture (13). The cylindrical container (11) is axially rotatable between a position in which said slotted aperture (13) faces said slotted hole (9), and a position in which it does not.

20 Claims, 2 Drawing Sheets

MULTI-PURPOSE ACCESSORY FOR SMOKERS

FIELD OF THE INVENTION

This invention relates to a multi-purpose accessory for smokers.

BACKGROUND OF THE INVENTION

Smokers need to carry their cigarettes and a lighter. They also need to convenient place to store the ashes from the cigarette if an ash tray is not available. Also, if a smoker is about to enter a non-smoking area, a convenient method of extinguishing a lighted cigarette is needed.

It is an object of the invention to provide a case to hold a pack of cigarettes, a lighter and a container for ashes.

It is another object of the invention to provide a case that provides a place to rest a lit cigarette.

It is still another object of the invention to provide a case that is compact and easy to carry.

It is another object of the invention to provide an accessory that serves to hold a packet of cigarettes, hold a means to light cigarettes, provide a surface for rested a lighted cigarette, provide a depression to hold ashes from a cigarette, provide an extinguisher to extinguish a lighted cigarette and provide a container to store cigarette ashes and butts.

These and other object will become apparent after reading the following disclosure.

SUMMARY OF THE INVENTION

The object of the invention is to provide a multi-purpose accessory provided with all the means required by the smoker for housing the cigarettes and cigarette lighter, resting the cigarette during use, extinguishing it when required and disposing of the ash and cigarette-end.

This object and further ones are attained according to the invention through a multi-purpose accessory, consisting of a substantially parallelepiped rigid casing able to house a packet of cigarettes and a cigarette lighter, the casing comprising a major surface having a shaped depression for resting the cigarette, an end portion of the casing having a cylindrical body in which a corresponding container is inserted. The cylindrical body has a longitudinally slotted hole. The cylindrical container has a longitudinally slotted aperture, and is axially rotatable between a position in which the slotted aperture faces the slotted hole, and a position in which it does not.

BRIEF DESCRIPTION OF THE DRAWINGS

The present invention is further clarified hereinafter with reference to the accompanying drawings, in which.

DETAILED DESCRIPTION OF THE INVENTION

Figure 1:
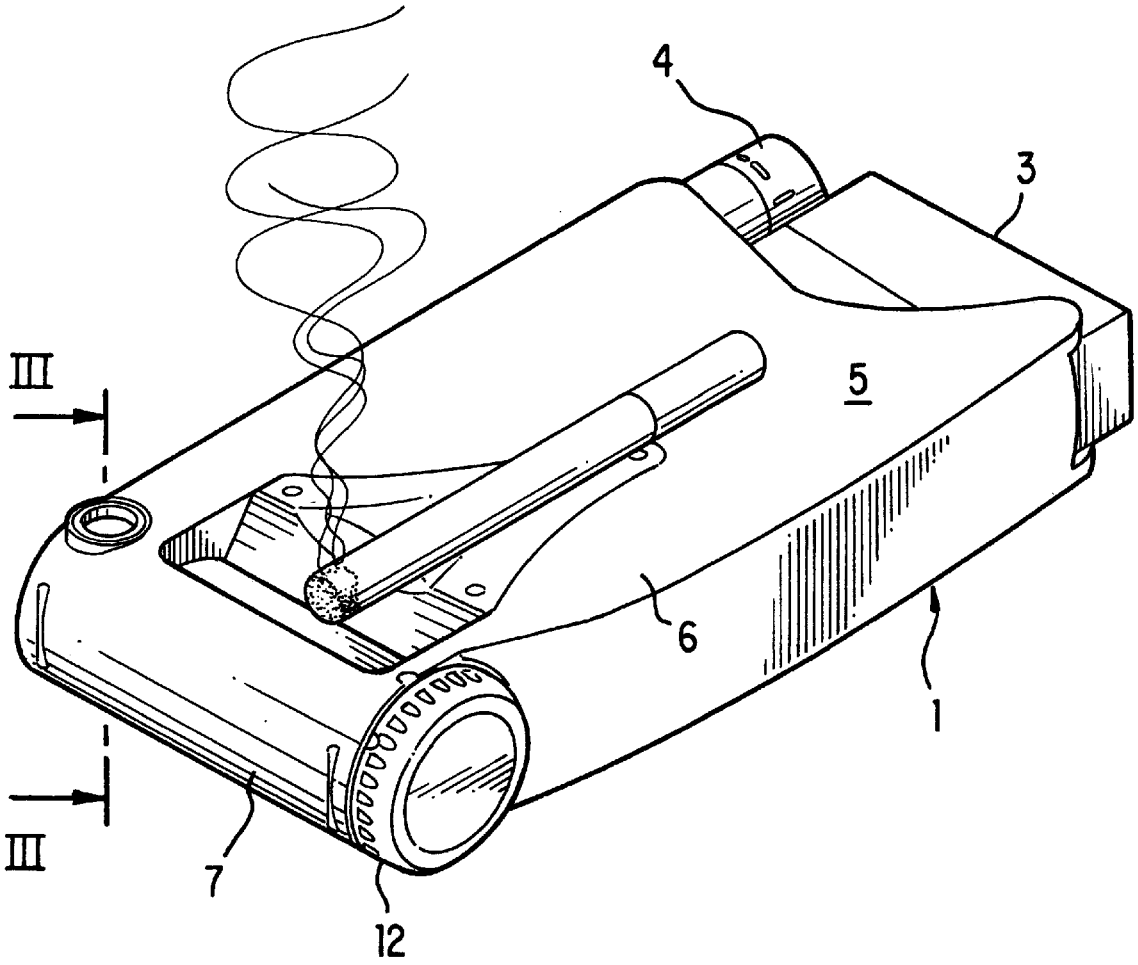
FIG. 1 is a perspective view of an accessory according to the invention.
Figure 2:
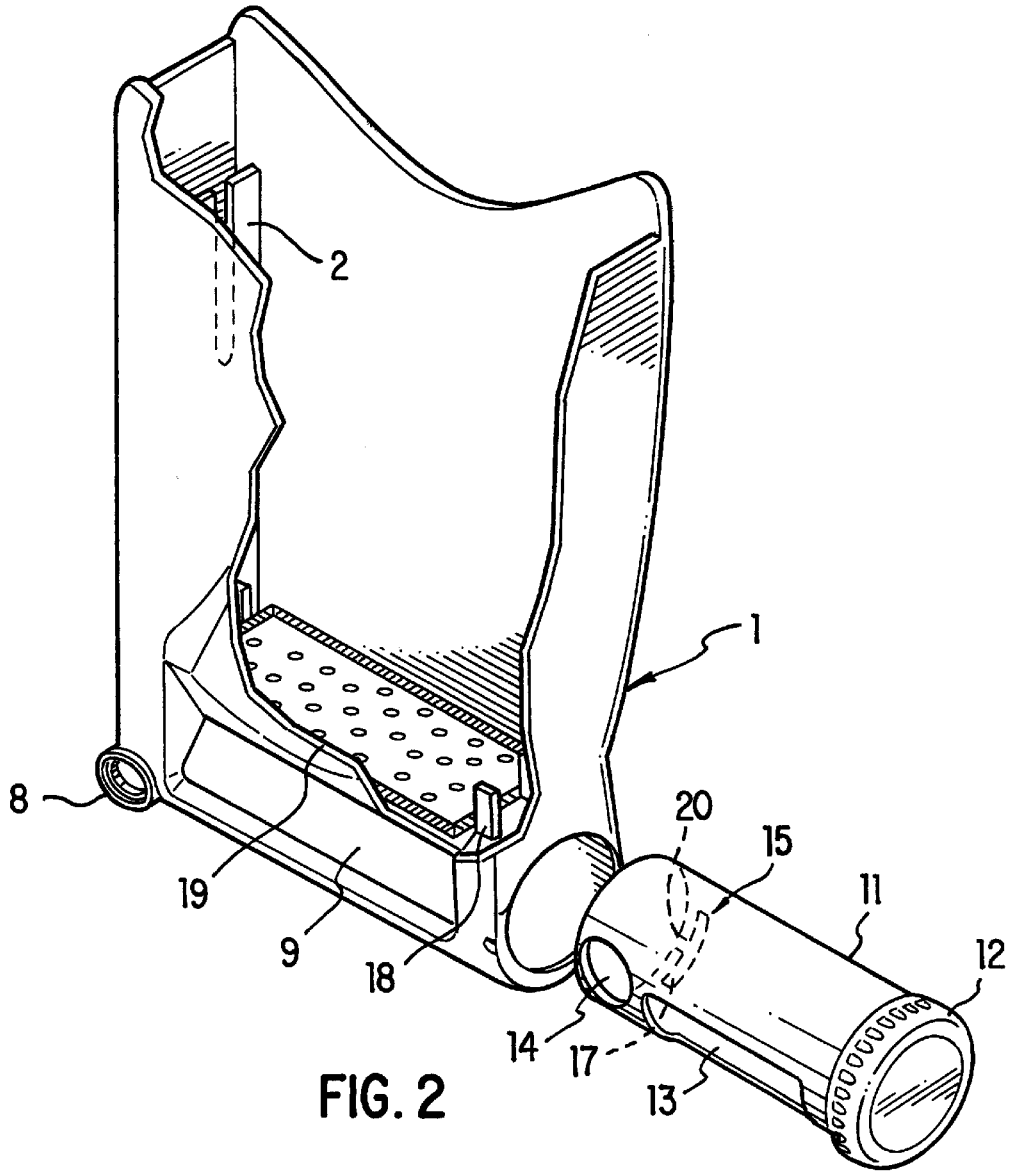
FIG. 2 is a partially cut-away exploded perspective view thereof.
Figure 3:
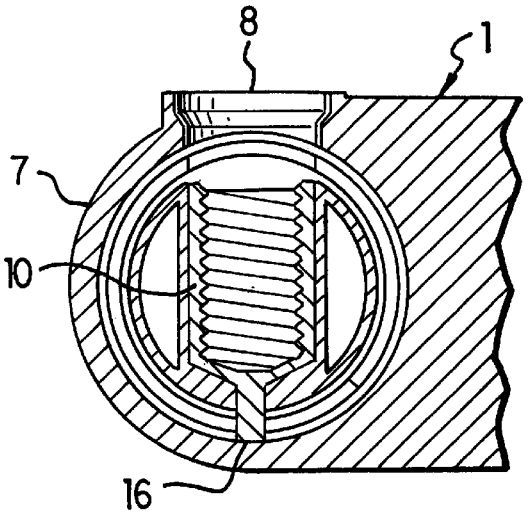
FIG. 3 is a longitudinal section through the line III—III of FIG. 1.

As can be seen from the figures, the accessory according to the invention consists essentially of a substantially parallelepiped rigid casing 1 of plastics having a baffle 2 defining two compartments suitable for housing a packet 3 of cigarettes and a disposable cigarette lighter 4.

The casing has a major surface 5 with a depression 6 inclined towards one end of the casing. This end is in the form of a hollow cylindrical body 7 having the slotted hole. The depression provides a place to rest a cigarette and a means to catch ashes and direct them to the cylindrical body.

The outer surface of the cylindrical body 7 comprises a hole 8 having a diameter corresponding to the diameter of a cigarette, and a slotted hole 9. The slotted hole is at the deepest end of the depression 6.

The interior of the cylindrical body 7 houses an extinguisher element 10 consisting of a brass block provided with an internally threaded cylindrical cavity. The interior of the cylindrical body 7 removably houses a plastic container 11 provided with a knurled knob 12. This container has a slotted aperture 13 and a hole 14.

The end portion of the cylindrical container having the circular hole 14 is also provided with a T-shaped cut 15. A pin 16 in the cylindrical body 7 engages in portion 20 of the T-shaped cut 15, during the insertion of the container 11. The pin 16 is provided under the extinguisher element 10. The pin engages, following the axial rotation of the extinguisher element, with appendice 17 of the T-shaped cut 15. The two end-of-travels substantially correspond to the steady conditions in which the hole 14 and the slotted aperture 13 are faced respectively to the cylindrical cavity of the extinguisher 10 and the slotted hole 9.

The compartment intended to house the packet of cigarettes comprises a base surface with two ribs 18 that maintain the packet spaced from the base of the compartment to form a space for housing odor-absorbing granules 19.

In using the accessory according to the invention, under normal conditions the cylindrical container 11 is inserted into the body 7 and rotated into a limiting position such that the longitudinal aperture 13 does not face the slotted hole 9, while at the same time the end portion is interposed between the hole 8 of the casing and the cavity of the extinguisher element 10.

At the moment of use the user, having extracted the cigarette from the packet and having lit it through the lighter 4, rests the accessory on a horizontal surface and rotates the container 11 by means of the knurled knob 12, so that the slotted aperture 13 faces the slotted hole 9 of the body 7 to correspondingly provide access to the container interior. This rotation also enables the hole 8 to be aligned with the hole 14 of the plastic container 11 and therefore with the cavity of the extinguisher element 10.

The cigarette is occasionally rested in the depression 6 such that its lighted end is substantially positioned in correspondence with the slotted hole 9 and the ash can fall into the container 11.

When the user wishes to extinguish the cigarette, he need only insert the lighted end of the cigarette through the hold 8 and then into the cavity of the extinguisher element 10, to achieve rapid extinguishing by virtue of the presence of the threaded surface. The extinguished cigarette-end is then inserted into the container 11.

At this point, by means of the knurled knob 12, the user rotates the cylindrical container 11 until its lateral surface closes the slotted hole 9 and its end portion again becomes interposed between the hole 8 and the cavity of the extinguisher. When the cylindrical container has been completely filled with ash and extinguished cigarette-ends, it can be extracted form the body 7 and its contents emptied into a suitable container (dust-bin etc.).

I claim:

1. A smoker's accessory comprising:

a case for housing a packet of cigarettes and a cigarette lighter, said case having a major surface and an end portion, said end portion having a cylindrical body, said cylindrical body having a first slotted aperture, a cylindrical container for receiving cigarette ash and butts insertable into said cylindrical body, said cylindrical container having a cylindrical side wall and a second slotted aperture, and said cylindrical container being rotatable between a first position where said first slotted aperture and second slotted aperture are in registry for receiving ashes and butts and a second position where said first slotted aperture and second slotted aperture are out of registry said first slotted aperture is closed by said cylindrical side wall of said cylindrical container when said first slotted aperture and said second slotted aperture are out of registry.

2. The accessory of claim 1 wherein said major surface has a depression adapted to receive a cigarette, and catch ashes from a lighted cigarette.

3. The accessory of claim 2 wherein said depression slopes downward to a deep end, the deep end being proximate said first slotted aperture to direct ashes through the first slotted aperture and into the cylindrical container.

4. The accessory of claim 1, further comprising an extinguisher element housed in said cylindrical body for extinguishing a cigarette.

5. The accessory of claim 4, wherein said extinguisher element is a block having an internally threaded cavity.

6. The accessory according to claim 1, further comprising a partition in the case wherein said partition has two ribs for spacing a packet of cigarettes from said partition and creating a space for odor absorbing granules.

7. The accessory according to claim 5, wherein said extinguisher element block is attached to the cylindrical body by a pin.

8. The accessory according to claim 7, wherein said the cylindrical container has a track, the pin engaging with the track.

9. The accessory according to claim 8, wherein said track is T-shaped to provide rotational limits for the cylindrical container.

10. The accessory according to claim 1, further including a baffle to separate the case into two compartments.

11. A smoker's accessory comprising:

a rigid case for housing a packet of cigarettes and a cigarette lighter, said case having a major surface and an end portion, said end portion having a cylindrical body, said cylindrical body having a first slotted aperture, a cylindrical container, for receiving cigarette ash and butts, insertable into said cylindrical body, said cylindrical container having a second slotted aperture, said first slotted aperture and said second slotted aperture having the same length and width;

said cylindrical container being rotatable between a first position where said first slotted aperture and said second slotted aperture are in registry and a second position where said first slotted aperture is closed by a lateral surface of said cylindrical container, said cylindrical body housing an extinguisher block element for extinguishing a cigarette, said block having a cylindrical internally helicoidally threaded cavity, said cylindrical body having a third aperture above said extinguisher element to provide access to said extinguisher element, said cylindrical container having a fourth aperture which is in registry with the third aperture of said cylindrical body when said cylindrical container is in the first position.

12. The accessory of claim 11, wherein said major surface has a depression adapted to receive a cigarette, and catch ashes from a lighted cigarette.

13. The accessory of claim 12, wherein said depression slopes downward to a deep end, the deep end being proximate said first slotted aperture to direct ashes through said first and second slotted apertures and into said cylindrical container.

14. The accessory of claim 11, wherein said cylindrical container has a knurled knob.

15. The accessory according to claim 11, further comprising a partition in said case.

16. The accessory according to claim 15, wherein said partition has two ribs for spacing a packet of cigarettes from said partition and creating a space for odor absorbing granules.

17. The accessory according to claim 11, wherein said extinguisher element block is attached to said cylindrical body by a pin.

18. The accessory according to claim 17, wherein said cylindrical container has a track, the pin engaging with the track.

19. The accessory according to claim 18, wherein said track is T-shaped to provide rotational limits for said cylindrical container.

20. The accessory according to claim 11, further including a baffle to separate said case into two compartments.

* * * * *